US007537500B2

(12) United States Patent
Abdel-Maksoud et al.

(10) Patent No.: US 7,537,500 B2
(45) Date of Patent: May 26, 2009

(54) SHIP DRIVEN BY INBOARD ENGINES AND WATER JETS

(75) Inventors: Moustafa Abdel-Maksoud, Berlin (DE); Hannes Schulze Horn, Gladbeck (DE); Kay Tigges, Harsefeld (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/587,575

(22) PCT Filed: Apr. 14, 2005

(86) PCT No.: PCT/DE2005/000670

§ 371 (c)(1),
(2), (4) Date: Oct. 25, 2006

(87) PCT Pub. No.: WO2005/105571

PCT Pub. Date: Nov. 10, 2005

(65) Prior Publication Data

US 2007/0232158 A1 Oct. 4, 2007

(30) Foreign Application Priority Data

Apr. 29, 2004 (DE) ..... 10 2004 021 273

(51) Int. Cl.
*B63H 11/00* (2006.01)

(52) U.S. Cl. ..... 440/79

(58) Field of Classification Search ..... 440/6, 440/79, 80, 83, 66, 68–70; 114/151, 61.1
See application file for complete search history.

(56) References Cited

U.S. PATENT DOCUMENTS

| | | | | | |
|---|---|---|---|---|---|
| 2,692,570 | A | * | 10/1954 | Costa | 114/77 A |
| 4,548,148 | A | * | 10/1985 | Bloomfield, III | 114/66 |
| 4,550,673 | A | * | 11/1985 | Ingvason | 114/61.28 |
| 4,634,389 | A | * | 1/1987 | Eptaminitakis | 440/53 |
| 4,678,439 | A | * | 7/1987 | Schlichthorst | 440/11 |
| 5,795,199 | A | * | 8/1998 | Langenberg et al. | 440/79 |
| 7,061,147 | B2 | * | 6/2006 | Ries | 310/54 |

FOREIGN PATENT DOCUMENTS

| | | |
|---|---|---|
| DE | 31736 C | 12/1884 |
| DE | 10224012 A1 | 12/2003 |
| WO | W0 02/057132 | 7/2002 |

OTHER PUBLICATIONS

PCT/ISA/210.

* cited by examiner

*Primary Examiner*—Ed Swinehart
(74) *Attorney, Agent, or Firm*—Harness, Dickey & Pierce, P.L.C.

(57) ABSTRACT

A ship is disclosed which is driven by inboard engines with propellers and by water jets producing jets of water. The inboard engines are embodied in the form of electric motors and the water jets are used underneath the bottom of the ship. The electric inboard engines are accommodated in skegs on the underside of the ship. A flow channel is formed between the skegs for the jets of water emitted by the water jets.

13 Claims, 6 Drawing Sheets

SHIP DRIVEN BY INBOARD ENGINES AND WATER JETS

PRIORITY STATEMENT

This application is the national phase under 35 U.S.C. § 371 of PCT International Application No. PCT/DE2005/000670 which has an International filing date of Apr. 14, 2005, which designated the United States of America and which claims priority on German Patent Application number 10 2004 021 273.2 filed Apr. 29, 2004, the entire contents of which are hereby incorporated herein by reference.

FIELD

Embodiments of the invention are generally directed to a marine vessel propelled by inboard motors with propellers and by waterjets which produce jets of water. For example, they may be directed to one with the inboard motors being in the form of electric motors and the waterjets being arranged under the bottom of the marine vessel.

BACKGROUND

A marine vessel, in particular a high-speed, sea-going vessel, with waterjets arranged under the bottom of the marine vessel and electric steering propellers for propulsion of the marine vessel is known from WO 02/057132 A1, in particular from FIG. 2. An arrangement and stern configuration such as this does not, however, result in separation of the water flows produced by the waterjets from the water area in which the propellers run. However, this is achieved by the flow channel that is used according to the invention between skegs on the underneath of the marine vessel.

The article "Korvetten von Blohm and Voss" [Blohm and Voss Corvette] in the journal "Schiff+Hafen" [Marine Vessel+Harbor], 12/96 pages 37 and 38 discloses a marine vessel which has two diesel direct propulsion systems for propellers and a waterjet, which are arranged together in the stern of the marine vessel. However, particularly for naval vessels, arrangements such as these have the disadvantage that all of the propulsion units are arranged in the stern and will fail at the same time in the event of a hit on the stern. Furthermore, the known waterjet produces a large amount of noise, which is undesirable. It is not possible to achieve a synergetic effect to increase the overall thrust.

SUMMARY

At least one embodiment of the invention specifies a configuration at the stern and under the bottom of a marine vessel which, in comparison to known marine vessels which are equipped with electric inboard motors and waterjets, results in higher propulsion efficiency. In at least one embodiment, the electric inboard motors are accommodated in skegs on the underneath of the marine vessel and with a flow channel for the jets of water emitted from the waterjets being formed between the skegs. This configuration, according to at least one embodiment of the invention, of the area underneath the bottom of the vessel in the stern area results in very good flow conditions for the individual propulsion devices with a propulsion efficiency which is increased, in particular for the propellers. This is made possible by the channel flow, which results from the jets from the waterjets being guided in a flow channel.

In the flow channel which is formed according to at least one embodiment of the invention, the boundary layer, which is thick in the stern area, is made thinner by the influence of the high-speed jets from the waterjets, resulting in fewer non-stationary effects at the respective propeller. Furthermore, the flowspeed on both sides of the respective skeg is matched. This results in improved propulsion efficiency for the propellers, with less tendency for cavitation. Furthermore, the tendency to vibrate is reduced, and, surprisingly, this also improves forward travel in a straight line.

The jets from the waterjets in the flow channel according to at least one embodiment of the invention interact with the propellers of the inboard motors in a synergetic manner, thus increasing the overall thrust of the combination of the propellers and waterjets beyond that which can be expected from their individual thrusts. One refinement of at least one embodiment of the invention provides that the flow channel behind the waterjets rises with a continuous profile towards the stern of the marine vessel, starting in the area of the bottom of the marine vessel approximately between a half and a third of the way along the length of the marine vessel. This embodiment of the flow channel results in the jets from the waterjets advantageously rising above the plane on which the propellers run. The jets from the waterjets are thus separated from the area of the water in which the propellers of the inboard motors run. At the same time, the propellers profit from the higher-speed flow in the flow channel.

In addition to raising the jets of water from the waterjets towards the stern, at least one embodiment of the invention provides that the flow channel has a guide wedge for the water, whose tip points towards the stern of the marine vessel and which has an approximately triangular cross section. This embodiment of the front part of the flow channel results in the jets from the waterjets being concentrated in the center of the flow channel. In this case, the jets from the waterjets are advantageously not only raised above the plane on which the propellers of the inboard motors run, but are also concentrated between the propellers of the inboard motors. The propulsion efficiency of the propellers is thus not negatively influenced by the jets from the waterjets, but in fact is surprisingly increased.

At least one embodiment of the invention also provides that the skegs have a droplet-shaped cross section which, in particular, is inclined outwards, with the inner faces of the skegs running approximately at right angles to the bottom of the marine vessel. This results in a low-drag flow channel, which is bounded by streamlined side flow guidance elements, specifically the droplet-shaped skegs. Overall, this therefore results in reduced stern drag for the marine vessel according to the invention, despite the flow guidance elements arranged at the stern, such as the guide wedge in the flow channel or the skegs. The electric motors may be in the form of tandem propulsion systems, in order to increase redundancy and to make them physically smaller.

It is particularly advantageous for the inboard motors to be designed using HTS technology. It is then possible to arrange the respective HTS motor at the aft and in the skegs, so that no space is required for the motors in the marine vessel. This is the case in particular when the HTS motors are arranged, for example, in the area of the shaft tunnels which are required and are located in the skegs. The use of HTS motors in this case results in a particularly lightweight stern even though the motors are arranged very well aft. The stern weight when using HTS motors is considerably less than when using diesel direct propulsion systems.

A further refinement of at least one embodiment of the invention provides that the HTS motor has a stator/rotor arrangement which can withstand shock loads as a unit and is mounted such that shocks are absorbed in the motor housing.

The use of a stator/rotor arrangement which can withstand shock loads as a unit makes it possible for electric motors to withstand high shock loads even if they are not designed using HTS technology, but using normal technology. In order to reinforce this, at least one embodiment of the invention provides that, furthermore, the motor housing is arranged such that it elastically absorbs shock loads. This results in the individual motor parts having a duplicated absorption capability, which leads to a very high degree of insensitivity. Electric machines which are suspended and designed in this way can withstand accelerations of considerably more than 10 g.

Since the repair capabilities in the interior of the skegs under the stern of a marine vessel are not optimal, at least one embodiment of the invention provides that the electric motor, in particular in the design of an HTS motor, is arranged in a motor cassette which is mounted, in particular suspended, elastically. A motor cassette such as this can be replaced relatively easily in a port, so that a marine vessel with this motor arrangement can also be made operational once again relatively quickly even for example after hitting a mine under the stern. The electric motor, the short shaft and the propeller in this case advantageously form a replaceable unit.

One refinement of at least one embodiment of the invention provides for the electric motors in the skegs to be in the form of tandem motors, in particular tandem shaft motors. This advantageously makes it possible to improve the operational reliability of the propulsion system even further.

Provision is made for the marine vessel according to at least one embodiment of the invention that the marine vessel has fuel-cell modules and internal combustion engines which are distributed in the marine-vessel hull and produce the energy which is required by the propulsion components, that is to say by the electric inboard motors and the waterjets. The marine vessel according to at least one embodiment of the invention therefore not only has distributed propulsion devices but also distributed power generation devices, which make it particularly insensitive to damage resulting from external influences. Furthermore, this advantageously means that there is no central machine space, so that, particularly for luxury yachts, more valuable space is available in the interior of the marine vessel, to be precise approximately in the center of the marine vessel or in the front stern area. This is also advantageous for roll-on/roll-off ferries or container ships. In this case, more useable internal space is available.

Furthermore, at least one embodiment of the invention provides that the marine vessel has a standard AC supply network and a DC waterjet supply network, between which a switching coupling with a converter is arranged, in order to allow power to be transmitted from one network to the other network. This results in an overall marine vessel network in which the advantages of a DC network, which is particularly suitable for connecting power generation devices that are distributed in the marine vessel to one another, are combined with the advantages of an AC network for advantageous supply of a large load, such as the waterjets. In this case, the power supply devices may be not only diesel engines or fuel cells but also gas turbines. In particular, the DC waterjet supply network can thus be operated particularly advantageously.

Instead of the inboard motors envisaged according to at least one embodiment of the invention, it is, of course, also possible to use electric steering propellers (PODs), which are arranged behind the skegs. This once again results in the separation, which is advantageous according to at least one embodiment of the invention, between the flows from the waterjets and the area in which the propellers of the marine vessel run, but, as already stated, the weight to be accommodated in the stern is greater. Marine vessels such as these will thus have a so-called delta shape, in order to allow the high weight at the stern to be borne. This also applies when inboard motors are combined with electric steering propellers (PODs).

At least one embodiment the invention can be used not only for naval vessels but also for high-speed motor yachts, in particular luxury yachts. In marine vessels such as these, low emission levels and a large available space inside the marine vessel are important. At the same time, a high maximum speed should be achieved so that the embodiment of the invention of the marine vessel is particularly advantageous for both types of marine vessel. In this case, the comfort can be improved even further by providing the internal combustion engines and, if appropriate, reformers for hydrogen production for the fuel cells with reduced-pressure exhaust-gas outlet devices, such as those which are already known, for example, for submarines. A high degree of freedom from emissions is thus achieved, while improving the comfort of the passengers and crews at the same time. This avoids the otherwise normal pollution from exhaust gases. The envisaged propulsion and stern configuration concept is thus highly suitable for high-speed ferries.

BRIEF DESCRIPTION OF THE DRAWINGS

The invention will be explained in more detail with reference to example embodiments and drawings from which, in the same way as from the dependent claims and the description, further inventive advantages will also become evident.

In the figures.

DETAILED DESCRIPTION OF THE EXAMPLE EMBODIMENTS

Figure 1:
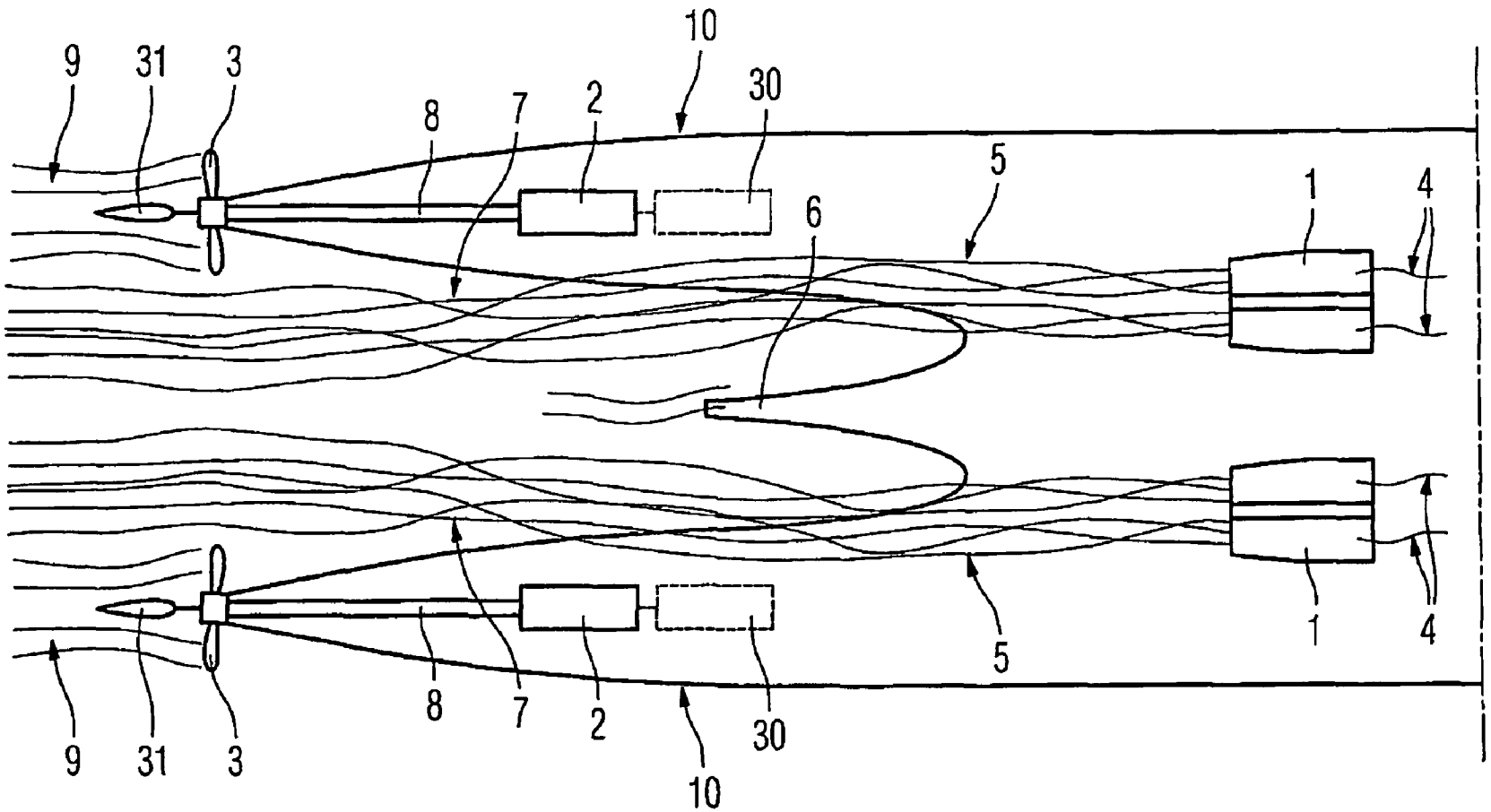
FIG. 1 shows the outline arrangement of the components in and under the stern of the marine vessel.

In FIG. 1, 1 denotes the waterjets under the bottom of the marine vessel, and 2 the inboard motors which drive the propellers 3 via short propeller shafts 8. The inboard motors 2 are arranged in skegs 10 which (together with the wedge-shaped displacement body 6 whose tip points towards the stern and which has a V-shaped cross section) form flow guidance bodies for the jets from the waterjets 5 which initially flow out without being deflected, and are then concentrated. The flow of the water into the waterjets 1 is denoted by 4. The water flowing away and which is being accelerated by the propellers is denoted by 9.

As can be seen from FIG. 1, one advantageous feature is that not only are the propellers kept free from the centrally concentrated flows from the waterjets 7, but this also results in the entire stern width of the marine vessel being used for the jets of water which are produced by the propulsion units 1 and 3. Optionally provided electric motors arranged in tandem are denoted by 30, and the rudders behind the propellers by 31.

Figure 2:
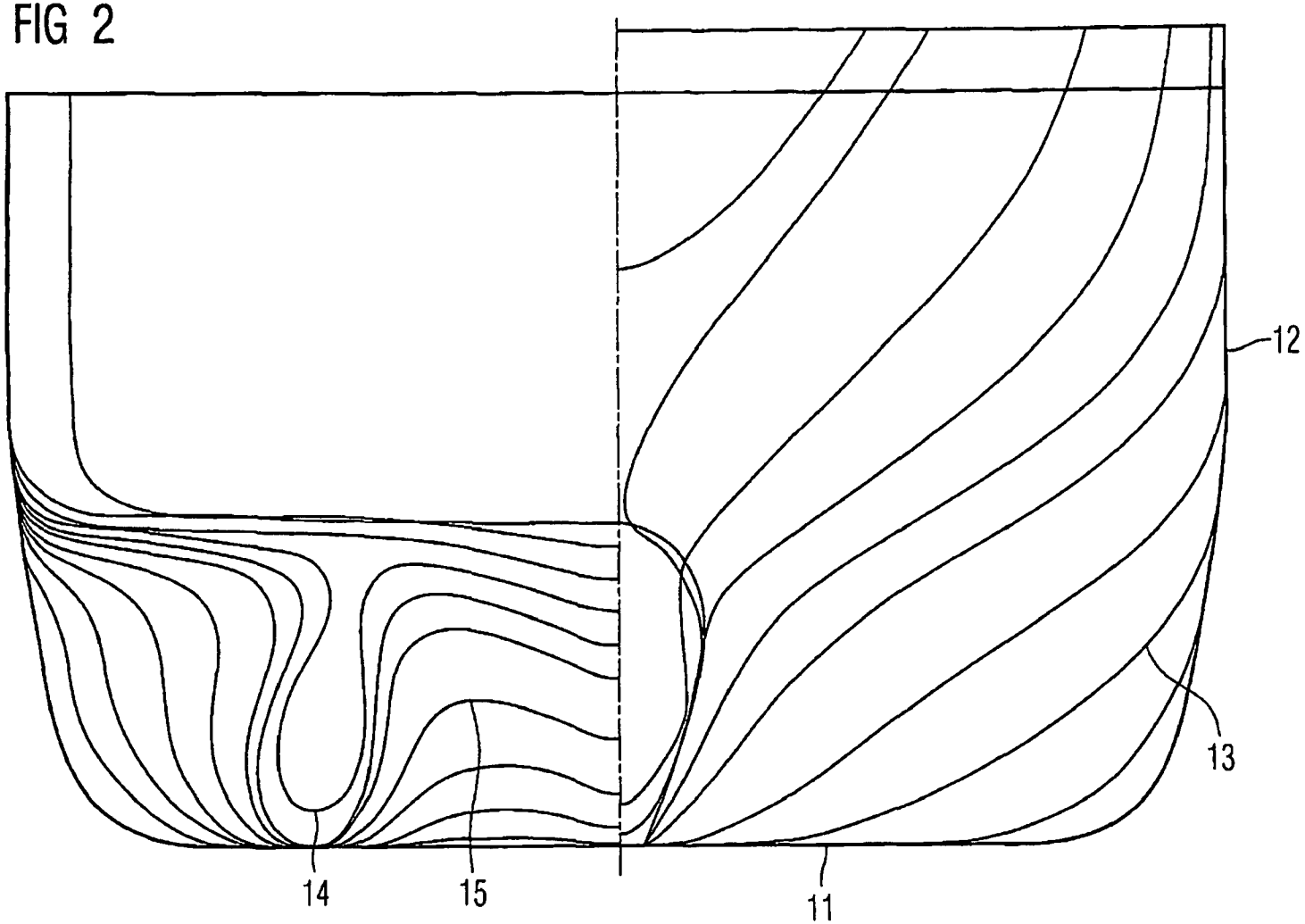
FIG. 2 shows the lines of the marine vessel in a view from astern, as is normal in ship construction.

In FIG. 2, 11 denotes the underneath of the marine vessel and 12 the side wall, whose profile runs into the bow along the length of the marine vessel, corresponding to the frame cross sections 13, which are illustrated in the normal manner for ship construction. Element 14 denotes the skegs on the underneath of the stern which run towards the stern as indicated by the frame outlines 15 shown in the figure. Overall, this results for a person skilled in the art in the frame profile in the stern and over the length of the marine vessel.

Figure 3:
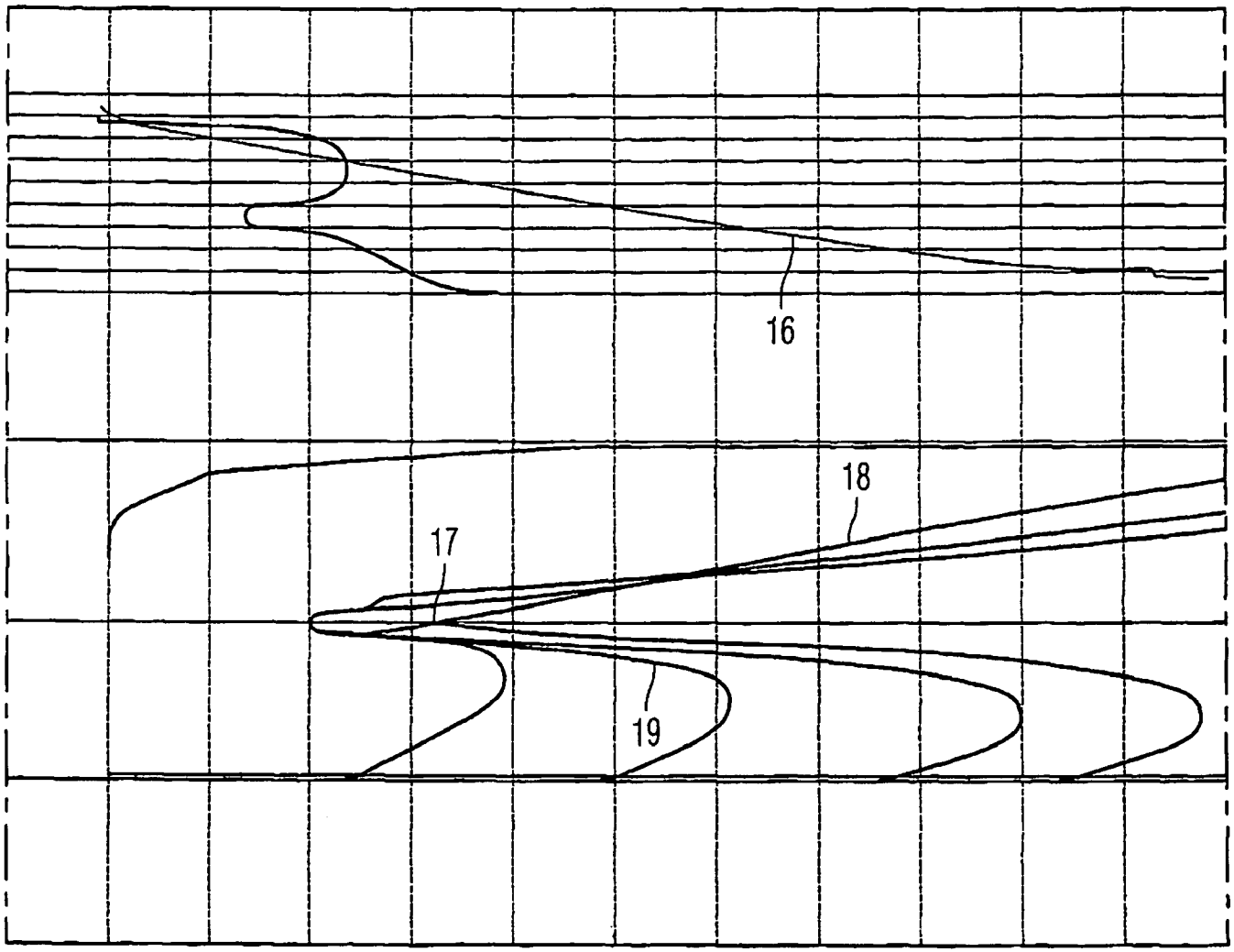
FIG. 3 shows the lines of the marine vessel in a view from the side, as is normal in ship construction.

FIG. 3 shows the line profile of the marine vessel in the area of the skegs, with 16 denoting the continuous rise in the flow channel between the skegs 17. The profile of the outer face and of the inner face of the skegs can be seen from the lines 18 and 19. Together with the stern lines from FIG. 2, this thus results, for a person skilled in the art, in a clear impression of the line profile of the marine vessel in the lower stern area.

Figure 4:
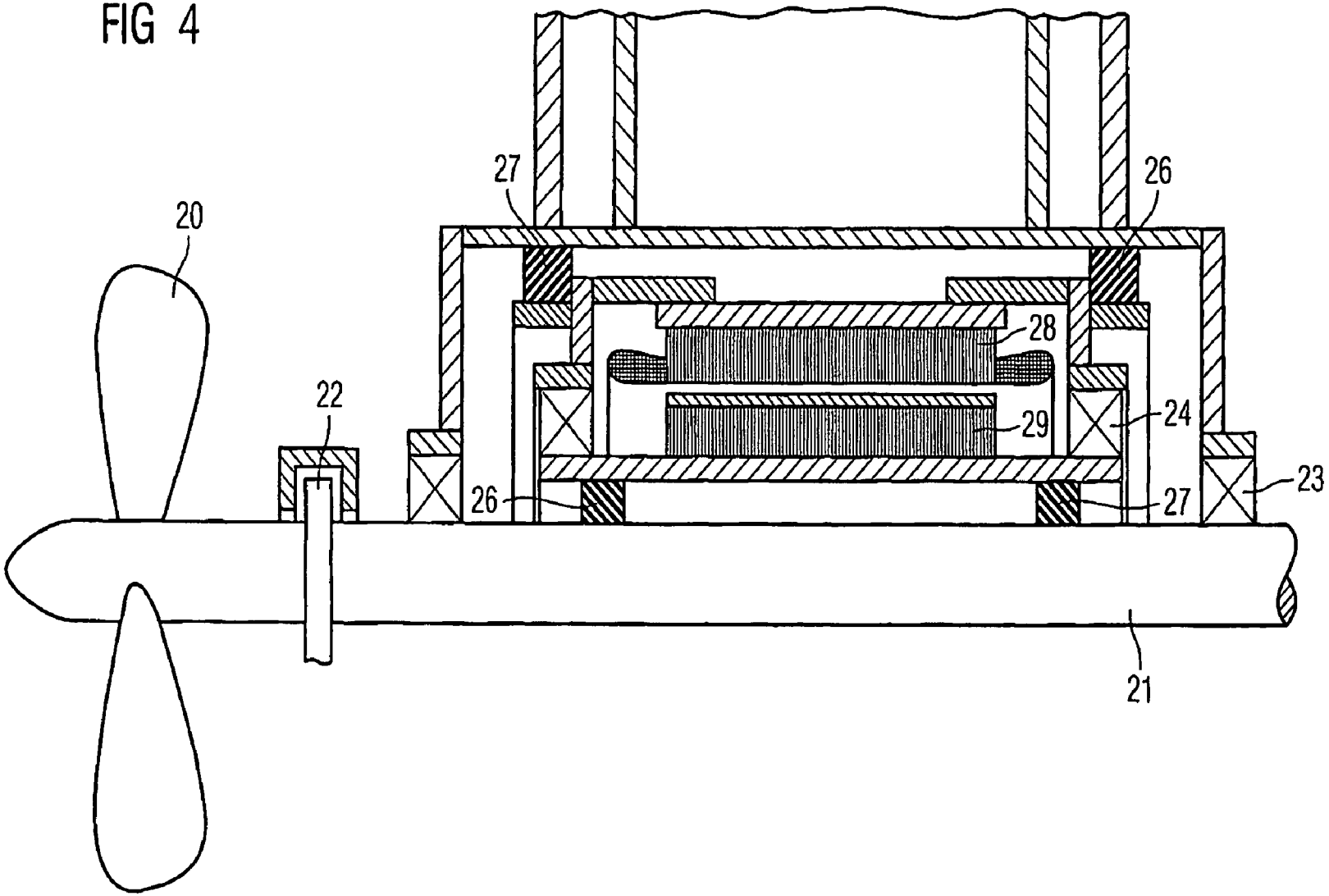
FIG. 4 shows an outline illustration of the rotor/stator arrangement of an electric motor with an absorption capability on a short propeller shaft.

In FIG. 4, 20 denotes the schematically illustrated propeller of the marine vessel, which is arranged on the propeller shaft 21 and has a thrust bearing 22 between the motor and the propeller. The stator and rotor of the motor 28, 29 are combined via rotating bearings 24 to form a unit which, overall, can absorb shocks on the elastic elements 26, 27. This thus results in an arrangement which prevents the motor parts, which rotate with respect to one another and are separated only by an air gap, from striking one another when subjected to high lateral acceleration. The design of a motor such as this is not the subject matter of embodiments of the invention and is already known. The use of the known design for the electric motors which, according to the invention, are located in the skegs is, however, particularly advantageous since this results in high shock resistance and thus high operational availability for naval (Navy) vessels.

Figure 5:
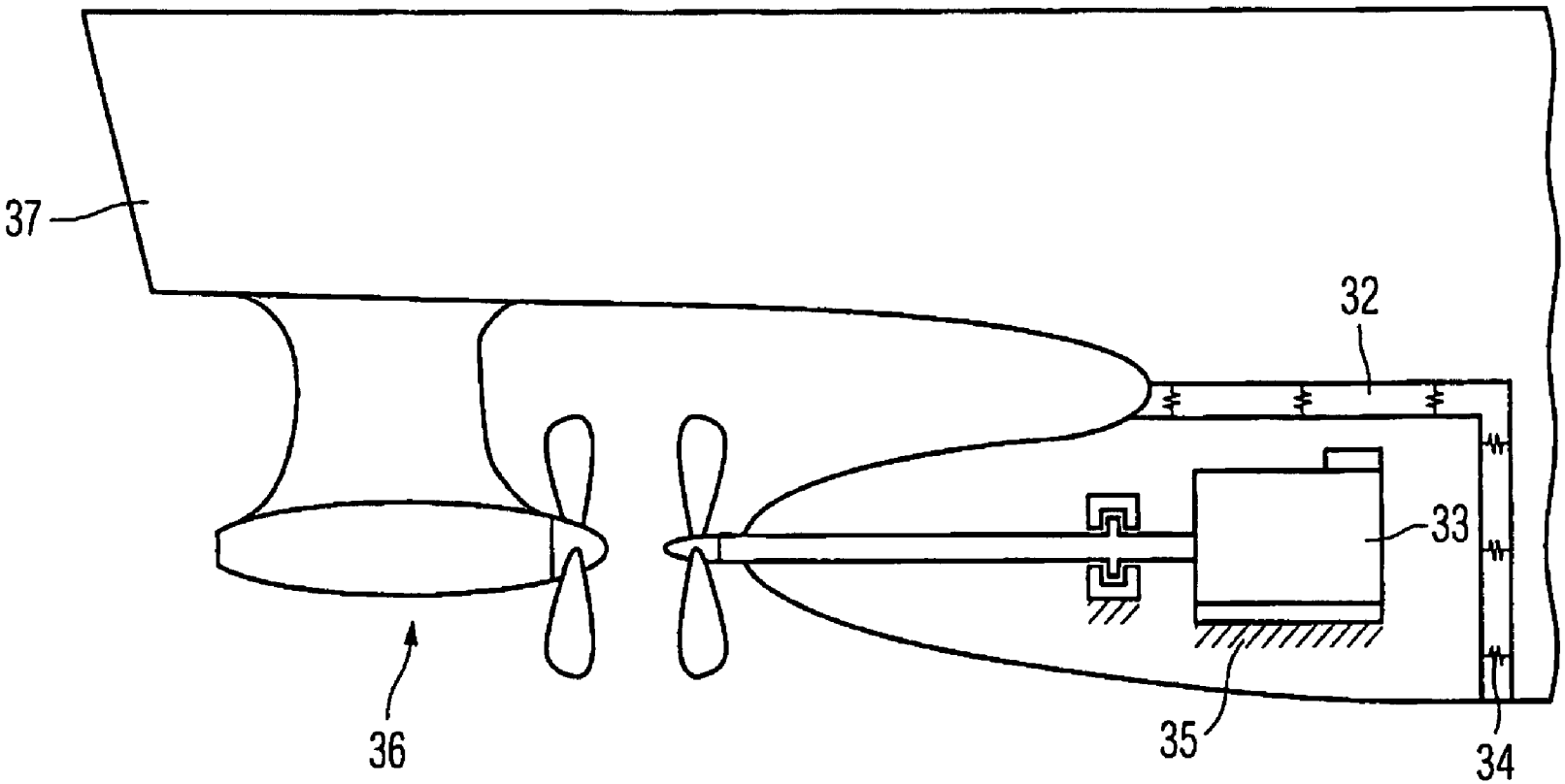
FIG. 5 shows the configuration of a propeller propulsion system, in cassette form, with an optional POD propulsion system.

In FIG. 5, which shows the cassette configuration of the propulsion unit, which is in each case arranged in a skeg, 32 denotes the so-called "cassette" in which the electric propulsion motor 33 is arranged via detachable spring elements 34. This results in further shock resistance, which is better than that of a fixed installation and, once the spring elements 34 have been detached, the motor can easily and simply be removed together with its bearing 35 in the cassette 32, thus avoiding time-consuming removal of the motor from the interior of the marine vessel. This also simplifies propeller repair.

Cassette motors such as these are relatively small, so that a POD propulsion system 36 can be installed under the stern of the marine vessel 37, increasing the propulsion power. Overall, this thus results in an electrical drive which can be replaced quickly, produces a large amount of forward thrust and has high efficiency, particularly when the propellers contra-rotate.

Figure 6:
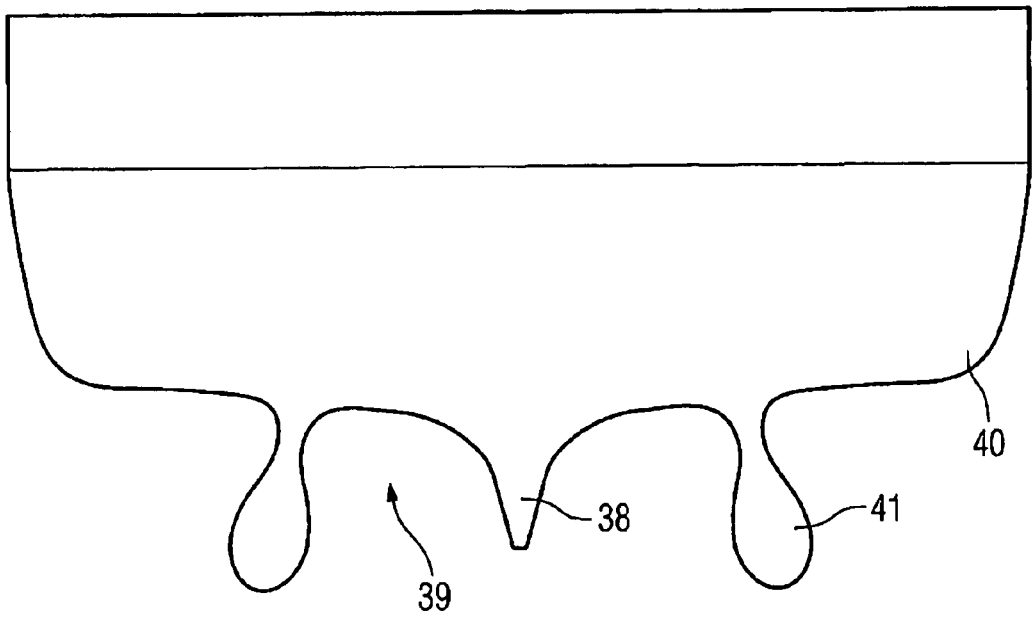
FIG. 6 shows the outline of the configuration under the bottom, in the area of the guide wedge.

In FIG. 6, 40 denotes the hull of the marine vessel according to an embodiment of the invention, and 41 the skegs in the stern area underneath the marine vessel. The guide wedge 38 is arranged between the skegs 41 and has a small end at the stern. Flow channels 39 are located between the skegs 41 and the guide wedge 38 and are combined astern of the end of the guide wedge 38. Since the flow follows the surface of the marine vessel, this leads to the advantageous concentration of the flow from the waterjets according to an embodiment of the invention.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A marine vessel, comprising:

inboard electric motors with propellers, the electric inboard motors accommodated in skegs underneath a marine vessel;

waterjets to produce jets of water, the waterjets arranged under a bottom of the marine vessel;

a flow channel for the jets of water emitted from the waterjets formed between the skegs and behind the waterjets, the flow channel to start in an area at the bottom of the marine vessel, and to rise with a continuous profile towards a stern of the marine vessel; and a guide wedge arranged in the front part of the flow channel having an apex to point towards the stern of the marine vessel and an approximately triangular cross section with the result that the jets from the waterjets are concentrated in the center of the flow channel between the propellers of the inboard motors.

2. The marine vessel as claimed in claim 1, wherein the skegs include a droplet-shaped cross section with a side of the skegs which faces the flow channel running approximately at right angles to the bottom of the marine vessel.

3. The marine vessel as claimed in claim 1, wherein propellers operate outside the jets from the waterjets, the jets from the waterjets to flow through a flow-channel configuration, which rises towards a stern, based on the guide wedge in an upper central area of the flow channel.

4. The marine vessel as claimed in claim 1, wherein the electric inboard motors include at least one motor, using high-temperature superconduction (HTS) technology, per propeller, with the HTS motor connected to the propeller via a short shaft and arranged approximately in the area of a shaft tunnel under the marine vessel.

5. The marine vessel as claimed in claim 4, wherein the HTS motor includes a stator/rotor arrangement mounted to absorb shocks in a motor housing.

6. The marine vessel as claimed in claim 4, wherein a motor housing is arranged to elastically absorbs shock loads.

7. The marine vessel as claimed in claim 1, wherein the marine vessel includes electric steering propellers, arranged behind the skegs.

8. The marine vessel as claimed in claim 1, wherein the marine vessel is a naval vessel.

9. The marine vessel as claimed in claim 1, wherein the marine vessel is at least one of a high-speed ferry and a luxury yacht.

10. The marine vessel as claimed in claim 1, wherein the marine vessel is a container ship.

11. The marine vessel as claimed in claim 1, wherein the guide wedge is used for the water in the flow channel in the area of the bottom of the ship in order to horizontally and vertically influence at least one of waterjet and propeller flows.

12. The marine vessel as claimed in claim 1, wherein the skegs include a droplet-shaped cross section which is inclined outwards, with a side of the skegs which faces the flow channel running approximately at right angles to the bottom of the marine vessel.

13. The marine vessel as claimed in claim 1, wherein the electric motors in the skegs are in the form of tandem propeller-shaft motors.

* * * * *